United States Patent [19]

Nelson et al.

[11] Patent Number: 5,076,233

[45] Date of Patent: Dec. 31, 1991

[54] DWELL LINKAGE

[75] Inventors: Dan E. Nelson, Wildwood; Louis R. Neal, Zion; Charles F. Erbach, Gurnee, all of Ill.

[73] Assignee: Outboard Marine Corporation, Waukegan, Ill.

[21] Appl. No.: 643,203

[22] Filed: Jan. 18, 1991

[51] Int. Cl.[5] ..... F02P 5/00

[52] U.S. Cl. ..... 123/413; 123/395; 123/400; 123/403

[58] Field of Search ..... 123/413, 395, 400, 403; 440/87; 74/470, 582

[56] References Cited

U.S. PATENT DOCUMENTS 4,747,381 5/1988 Baltz et al. ..... 123/413

4,788,955 12/1988 Wood ..... 123/413

*Primary Examiner*—Raymond A. Nelli

*Attorney, Agent, or Firm*—Michael, Best & Friedrich

[57] ABSTRACT

An engine including an engine block, and spark timing structure for advancing and retarding spark timing between a minimum spark advance and a maximum spark advance, the spark timing structure including a spark timing link comprising a stop and being movable between a minimum advance position and a maximum advance position spaced in one direction from the minimum advance position, the spark timing structure also including a spark timing lever including a surface and being movable between a first position wherein the surface is spaced from the stop when the link is in the minimum advance position, a second position wherein the surface engages the stop when the link is in the minimum advance position so as to provide common movement of the link and the spark timing lever in response to further movement of the lever in the one direction, and a third position wherein the link is in the maximum advance position when the surface engages the stop.

20 Claims, 4 Drawing Sheets

DWELL LINKAGE

BACKGROUND OF THE INVENTION

The invention relates generally to internal combustion engines, and, more particularly, to integrated control of the fuel supply and spark timing mechanisms of engines incorporated in outboard motors.

Attention is directed to U.S. Broughton et al. Pat. application Ser. No. 066,142, which was filed on June 24, 1987, which is assigned to the assignee of the present invention, and which is incorporated herein by reference.

SUMMARY OF THE INVENTION

The invention provides an engine comprising an engine block, a control lever supported by said engine block for pivotal movement about an axis and adapted to be connected to an operator controlled actuating member, a fuel supply mechanism operable between idle and full speed settings, means for displacing the fuel supply mechanism between the idle speed setting and the full speed setting in response to pivotal movement of the control lever, and spark timing means for advancing and retarding spark timing between a minimum spark advance and a maximum spark advance, and for beginning to advance the spark timing from the minimum spark advance only after displacement of the fuel supply mechanism from the idle speed setting to a first intermediate setting between the idle speed setting and the full speed setting, the spark timing means including a spark timing lever pivotally supported by the engine block for pivotal movement about the axis.

One aspect of the invention provides an engine comprising an engine block, and spark timing means for advancing and retarding spark timing between a minimum spark advance and a maximum spark advance, the spark timing means including a spark timing link comprising a stop and being movable between a minimum advance position and a maximum advance position spaced in one direction from the minimum advance position, the spark timing means also including a spark timing lever including a surface and being movable between a first position wherein the surface is spaced from the stop when the link is in the minimum advance position, a second position wherein the surface engages the stop when the link is in the minimum advance position so as to provide common movement of the link and the spark timing lever in response to further movement of the spark timing lever in the one direction, and a third position wherein the link is in the maximum advance position when the surface engages the stop.

Another aspect of the invention provides a marine propulsion device comprising a propulsion unit including a rotatably supported propeller shaft, and an engine drivingly connected to the propeller shaft, the engine comprising an engine block, a control lever supported by the engine block for pivotal movement about an axis and adapted to be connected to an operator controlled actuating member, a fuel supply mechanism operable between idle and full speed settings, means for displacing the fuel supply mechanism between the idle speed setting and the full speed setting in response to pivotal movement of the control lever, and spark timing means for advancing and retarding spark timing between a minimum spark advance and a maximum spark advance, for beginning to advance the spark timing from the minimum spark advance only after displacement of the fuel supply mechanism from the idle speed setting to a first intermediate setting between the idle speed setting and the full speed setting, for advancing spark timing from minimum spark advance to maximum spark advance in response to displacement of the fuel supply mechanism from the first intermediate setting to a second intermediate setting between the first intermediate setting and the full speed setting, and for maintaining maximum spark advance in response to displacement of the fuel supply mechanism from the second intermediate setting to the full speed setting, the spark timing means including a spark timing mechanism operable between minimum spark advance and maximum spark advance settings, a spark timing link that comprises a stop and that moves with predominantly translational motion between a minimum advance position and a maximum advance position spaced in one direction from the minimum advance position, means for displacing the spark timing mechanism between the minimum spark advance and the maximum spark advance in response to movement of the spark timing link from the minimum advance position to the maximum advance position, a spark timing lever including a surface and being pivotally supported by the engine block for pivotal movement about the axis and between a first position wherein the surface of the spark timing lever is spaced from the stop when the link is in the minimum advance position, a second position wherein the surface engages the stop when the link is in the minimum advance position so as to provide common movement of the link and the spark timing lever in response to further movement of the spark timing lever in the one direction, and a third position wherein the link is in the maximum advance position when the surface engages the stop, and means providing for common pivotal movement of the spark timing lever and the control lever while the fuel supply mechanism is displaced from the idle speed setting to the second intermediate setting, and providing for pivotal movement of the control lever independent of the spark timing lever while the fuel supply mechanism is displaced from the second intermediate setting to the full speed setting.

A principal advantage of the invention is the provision of a simpler, less expensive spark timing link for providing the relationship between throttle and spark advance disclosed herein.

Other features and advantages of the invention will become apparent to those of ordinary skill in the art upon review of the following detailed description of the preferred embodiment of the invention, reference being made to the appended drawings.

Figure 1:
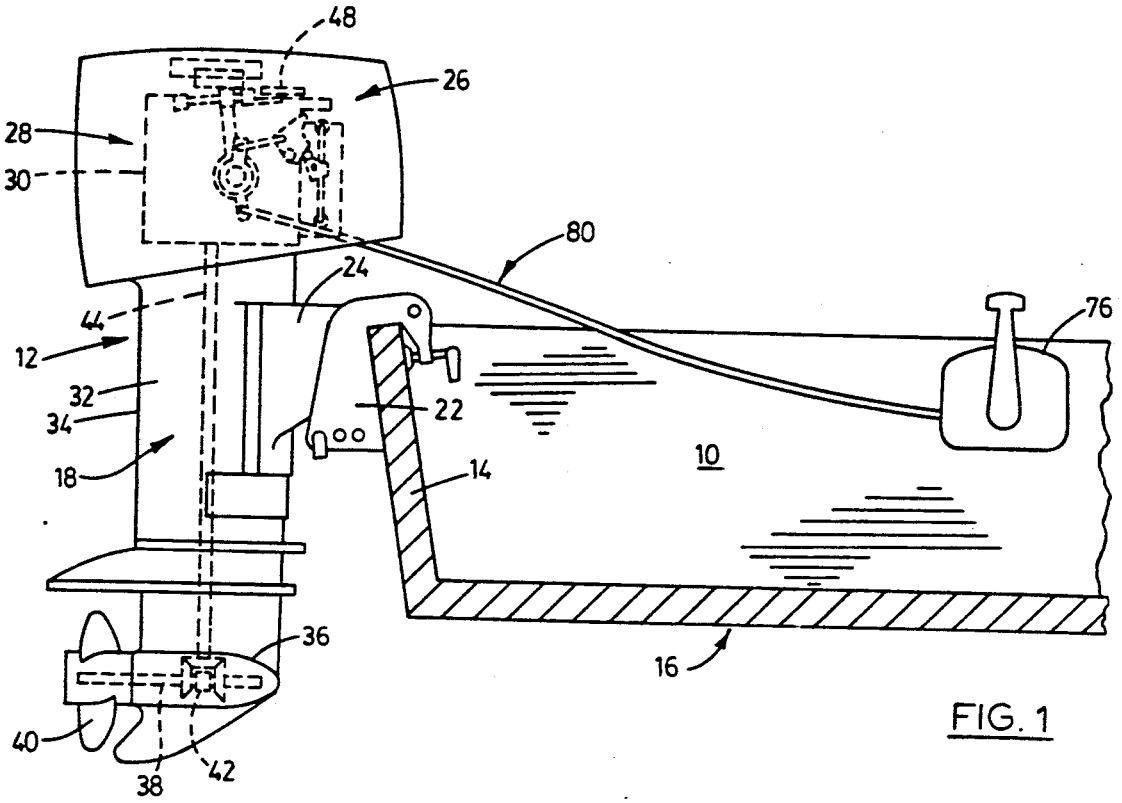
FIG. 1 is a fragmentary view, partially in section, of a marine propulsion installation incorporating various of the features of the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

DETAILED DESCRIPTION OF THE PREFERRED EMBODIMENT OF THE INVENTION

Shown in FIG. 1 is a marine installation 10 including a marine propulsion device in the form of an outboard motor 12 that is releasably mounted on the transom 14 of a boat 16.

The outboard motor 12 includes a propulsion unit 18 and means for supporting the propulsion unit 18 from the boat transom 14 for pivotal steering movement about a generally vertical axis and for pivotal tilting movement about a generally horizontal axis. While various arrangements can be employed, in the illustrated construction, such means comprises a transom bracket 22 releasably connected to the transom 14, and a swivel bracket 24 connected to the transom bracket 22 for pivotal movement relative thereto about a generally horizontal tilt axis. The propulsion unit 18 is connected to the swivel bracket 24 for pivotal movement relative thereto about a steering axis that extends generally vertically under normal operating conditions.

The propulsion unit 18 comprises a power head 26 that includes an internal combustion engine 28. The internal combustion engine 28 includes an engine block 30. The propulsion unit 18 also includes a lower unit 32 which includes a drive shaft housing 34. The drive shaft housing 34 has an upper end that supports the engine 28, and has a lower end. The lower unit 32 further includes a gear case 36 connected to the lower end of the drive shaft housing 34. The lower unit 32 further includes a propeller shaft 38 rotatably supported within the gear case 36, and a propeller 40 on the propeller shaft 38. The lower unit 32 further includes a reversing transmission 42, and a drive shaft 44 that is driven by the internal combustion engine 28. The reversing transmission 42 drivingly connects the drive shaft 44 to the propeller shaft 38.

The internal combustion engine 28 includes an ignition system (not shown). The ignition system is preferably a capacitor discharge system, and includes (see FIG. 6) one or more trigger coils (not shown) carried by a spark timing mechanism 48 that includes a timer base 51. The timer base 51 is supported by the engine block 30 for rotary movement about an axis 52 and in opposite rotary directions between a minimum spark advance setting (shown in FIGS. 2 and 3) in which the spark advance is at a minimum and a maximum spark advance setting (shown in FIGS. 4 and 5) in which the spark advance is at a maximum. In FIG. 6, spark advance occurs in response to counter-clockwise rotation of the timer base 51 and spark retard occurs in response to clockwise rotation of the timer base 51. The timer base 51 includes a socket or aperture 55, spaced from the axis of rotation 52 of the timer base 51, for a purpose that will later be described.

The internal combustion engine 28 also includes (see FIG. 2) a fuel supply mechanism 56. In the illustrated construction, the fuel supply mechanism comprises one or more carburetors 60 that are supported by the engine block 30 and that include respective throttles or valve plates 64 which are movable between an idle setting (shown in FIG. 2) and a full speed setting (shown in FIG. 5).

The internal combustion engine 28 further includes a control lever 68 supported by the engine block 30 for pivotal movement about an axis 72. The control lever 68 is connected to a user operable actuator, such as a single lever control 76 (FIG. 1) that is mounted on the boat 16, by a push-pull cable 80. The cable 80 is connected to the lever 68 at a location 84 on the control lever 68. Operation of the single lever control results in pivotal movement of the control lever 68 about the axis 72.

Figure 2:
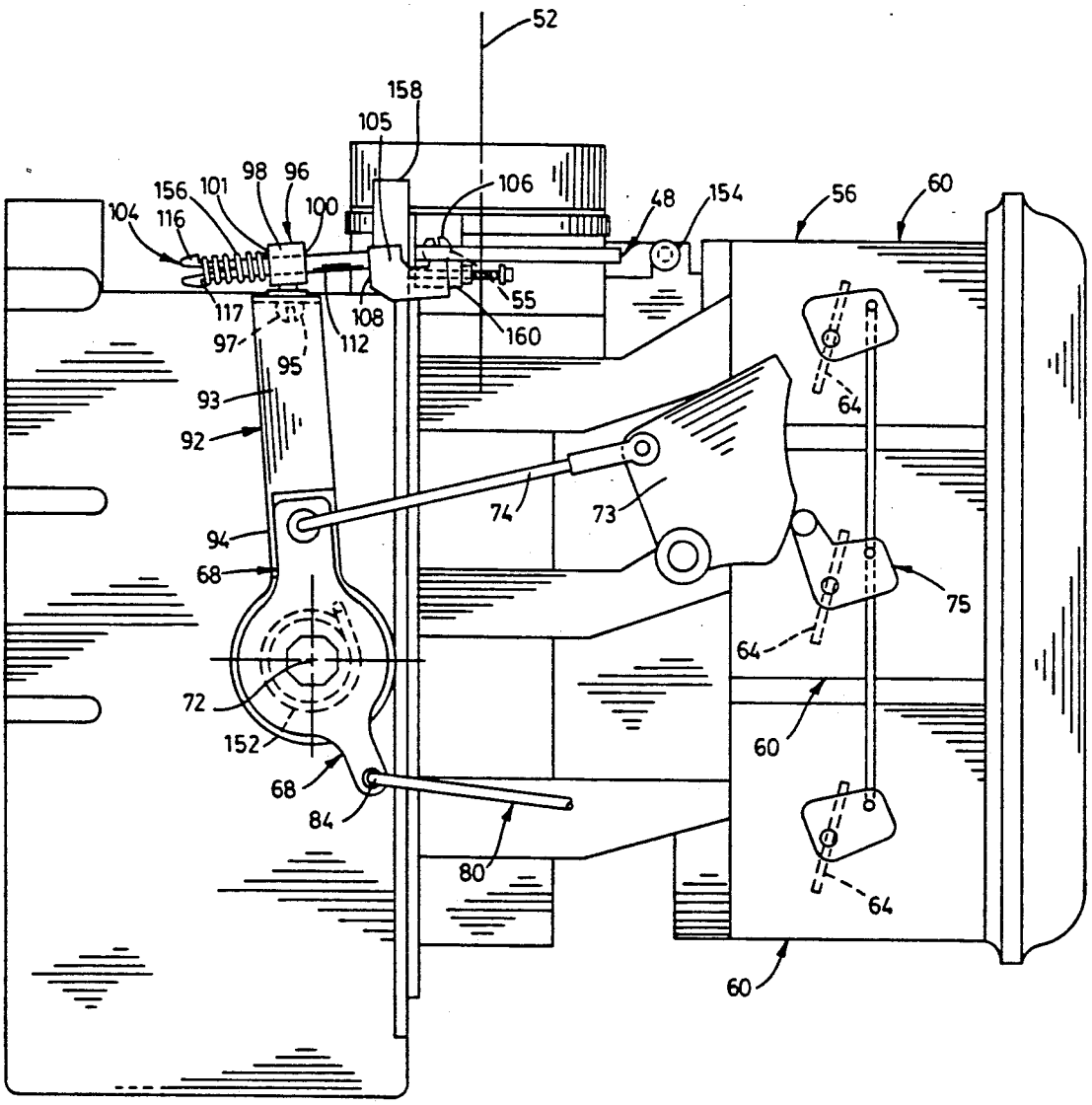
FIGS. 2-5 are side elevational views of an engine control mechanism incorporated in the marine propulsion device shown in FIG. 1, the control mechanism including a fuel supply mechanism, a spark timing plate, and levers.
Figure 5:
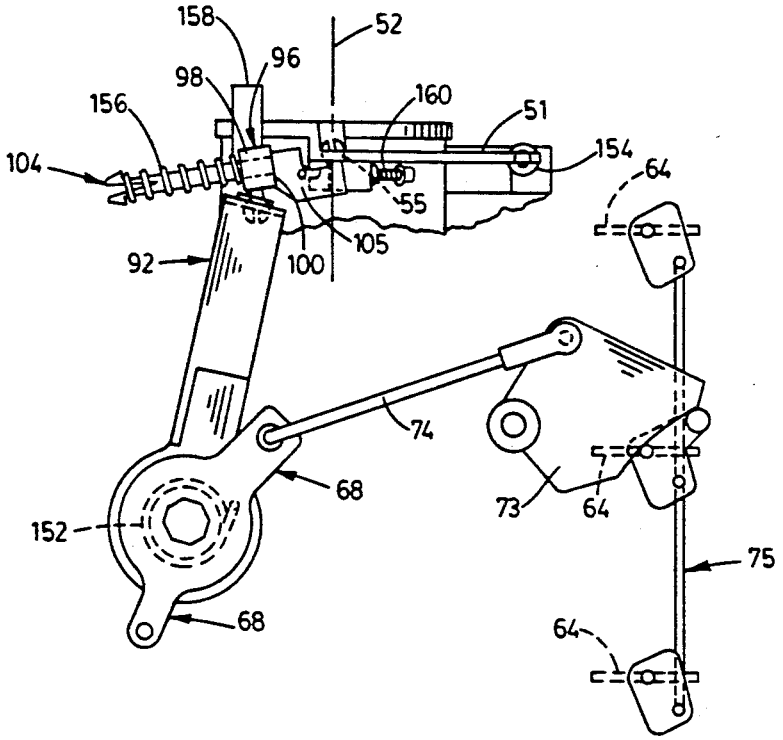
Figure 6:
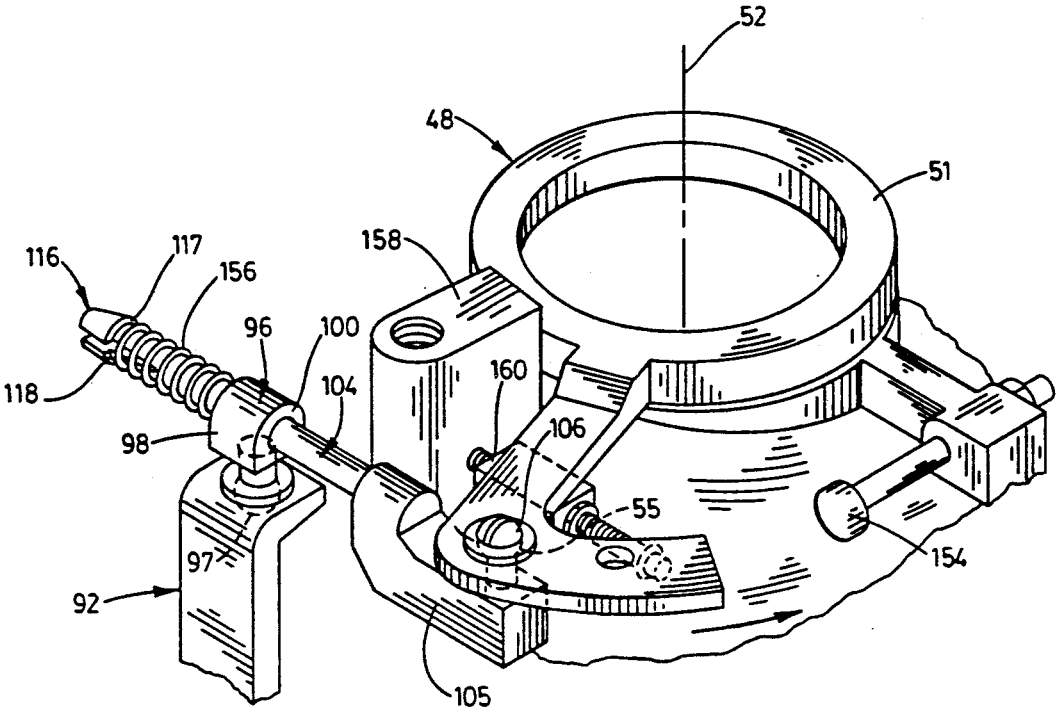
FIG. 6 is a fragmentary perspective view of a portion of the engine control mechanism shown in FIGS. 2-5, which portion includes the spark timing plate, a spark timing link, and a spark timing lever.

The internal combustion engine 28 further includes means for displacing the fuel supply mechanism 56 between the idle speed setting, shown in FIG. 2, and the full speed setting, shown in FIG. 5, in response to pivotal movement of the control lever 68. In the illustrated embodiment, the fuel supply mechanism displacing means includes (see FIG. 2) a throttle cam 73 pivotally supported by the engine block 30, a throttle link 74 connecting the throttle cam 73 to the control lever 68 so that pivotal movement of the control lever 68 results in pivotal movement of the throttle cam 73, and a cam follower mechanism 75 that moves the throttles 64 between the idle speed setting (FIG. 2) and the full speed setting (FIG. 5) in response to pivotal movement of the throttle cam 73. Such displacing means is conventional and need not be described in greater detail.

The internal combustion engine 28 further includes spark timing means for advancing and retarding spark timing between a minimum spark advance (FIGS. 2 and 3) and a maximum spark advance (FIGS. 3 and 4), for beginning to advance the spark timing from the minimum spark advance only after displacement of the fuel supply mechanism 56 from the idle speed setting (FIG. 2) to a first intermediate setting (FIG. 3) between the idle speed setting and the full speed setting (FIG. 5), for advancing spark timing from minimum spark advance to maximum spark advance in response to displacement of said fuel supply mechanism from said first intermediate setting to a second intermediate setting between said first intermediate setting and said full speed setting, and for maintaining maximum spark advance in response to displacement of said fuel supply mechanism from said second intermediate setting to said full speed setting.

The spark timing means includes the spark timing mechanism 48. While various other means can be employed, in the preferred embodiment, the spark timing means further includes (see FIGS. 2 and 6) a spark timing lever 92 including a main lever portion 93 having a first or lower end supported by the engine block 30 for pivotal movement about the axis 72, having a raised stop 94 which engages the control lever 68 so as to limit counter-clockwise movement of the control lever 68 relative to the spark timing lever 92 for a purpose that will later be described, and having a second or upper end with a socket 95 defined therein, the socket 95 facing radially away from the axis 72. The spark timing lever 92 further includes a tubular guide portion 96 that is preferably made of resilient material and is preferably manufactured by an injection molding process. The tubular guide portion 96 includes a split ball 97 resiliently mounted in the socket 95 in the main lever portion 93 for limited pivotal movement relative to the main lever portion 93. The tubular guide portion 96 also includes a tube 98 integrally connected to the split ball 97. The tube 98 defines opposed surfaces 100 and 101 (see FIGS. 2 and 6) for purposes that will later be described.

The spark timing means further includes means for displacing the timer base 51 of the spark timing mechanism 48 between the minimum spark advance setting (FIGS. 2 and 3) and the maximum spark advance setting (FIGS. 4 and 5) in response to pivotal movement of the spark timing lever 92.

While various other means can be employed, in the preferred embodiment, the means for displacing the spark timing mechanism 48 includes (see FIGS. 2 and 6) a spark timing link 104 connected to the spark timing mechanism 48. The spark timing link 104 is preferably made of resilient material and is preferably manufactured by an injection molding process. The spark timing link 104 includes a main body portion 105 defining a split ball 106 that is inserted and resiliently retained in the socket 55 in the timer base 51 for limited pivotal movement relative to the timer base 51. The main body portion 105 of the spark timing link 104 also defines a stop 108 for a purpose that will later be described. The spark timing link 104 further includes an elongated rod portion 112 extending from the stop 108 and through the tube 98 of the tubular guide portion 96. The spark timing link 104 further includes a tapered head 116 at an end of the rod portion 112 spaced from the stop 108. The head 116 is tapered radially outwardly in a direction axially toward the stop 108, and defines an enlarged diameter portion 117, and a surface 118 facing the stop 108 and extending between the enlarged diameter portion 117 and the rod portion 112. Preferably, the surface 118 defines a plane perpendicular to the rod portion 112. The head 116 and a portion of the rod portion 112 adjacent the head 116 are split to allow radially inward compression of the head 116 so that the tube 98 of the spark timing lever 92 can be slid over the head 116 to surround the rod portion 112. Since the spark timing link 104 is made of resilient material, the head 116 will return to its non-compressed state after the tubular guide portion 96 is slid over the head 116 and the surface 118 of the head 116 will, in the absence of other structure between the surfaces 101 and 118, engage the tube 98 so as to retain the tubular guide portion 96 in surrounding relation to the rod portion 112.

In operation, the spark timing link 104 moves with predominantly translational motion between a minimum advance position (FIGS. 2 and 3) and a maximum advance position (FIGS. 4 and 5) spaced in one direction (to the right in FIGS. 2-5) from the minimum advance position. The connection of the spark timing link 104 to the spark timing mechanism 48 provides means for displacing the mechanism 48 between minimum spark advance and maximum spark advance in response to movement of the link 104 from its minimum spark advance position to its maximum spark advance position. The spark timing lever 92 is movable between a first position (FIG. 2) wherein the tubular guide portion 96 is in a location such that the surface 100 is spaced from the stop 108 when the link 104 is in the minimum advance position (FIGS. 2 and 3), a second position (FIG. 3) wherein the surface 100 engages the stop 108 when the spark timing link 104 is in the minimum advance position (FIGS. 2 and 3) so as to provide common movement of the spark timing link 104 and the spark timing lever 92 in response to further movement of the spark timing lever 92 in the clockwise direction in FIGS. 3 and 4, and a third position (FIGS. 4 and 5) wherein the spark timing link 104 is in the maximum advance position (FIGS. 4 and 5) when the surface 100 engages the stop 108. The stop 108 preferably defines a vertical plane that is parallel to the direction in which the split ball 106 is inserted, during assembly, into the socket 55, and the elongated rod portion 112 preferably extends transversely from the stop 108 so as to reduce the possibility of the split ball 106 becoming disengaged from the socket 55 in response to movement of the link 104.

The spark timing means further includes means providing for common pivotal movement of the spark timing lever 92 and the control lever 68 while the fuel supply mechanism 56 is displaced from the idle speed setting (FIG. 2) to the second intermediate setting (FIG. 4), and providing for pivotal movement of the control lever 68 independent of the spark timing lever 92 while the fuel supply mechanism 56 is displaced from the second intermediate setting (FIG. 4) to the full speed setting (FIG. 5). While various other means could be employed, in the preferred embodiment, such means includes (see FIG. 2) a helical spring 152 acting between the control lever 68 and the spark timing lever 92. More particularly, in the embodiment illustrated in FIGS. 1-6, the helical spring 152 biases the spark timing lever 92 clockwise relative to the control lever 68. Clockwise movement of the spark timing lever 92 relative to the lever 68 is limited by the raised stop 94 on the spark timing lever 92 so that the spark timing lever 92 and the control lever 68 travel together during clockwise movement of the control lever 68 from the position shown in FIG. 2 to the position shown in FIG. 5, after which further clockwise movement of the spark timing lever 92 is prevented by an adjustable stop 154, included in the spark timing mechanism 48, for preventing the timer base 51 from being rotated past the maximum spark advance setting (FIGS. 4 and 5). This allows the control lever 68 to rotate further in the clockwise direction, independent of the spark timing lever 92 and against a counterclockwise force exerted on the control lever 68 by the helical spring 152, to the position shown in FIG. 5 whereat the fuel supply mechanism 56 is in the full speed setting.

In the illustrated embodiment, the fuel supply mechanism 56 is in its idle speed setting (FIG. 2) when the spark timing lever 92 is in its first position (FIG. 2), the fuel supply mechanism 56 is in its first intermediate setting (FIG. 3) when the spark timing lever 92 is in its second position (FIG. 3), and the fuel supply mechanism 56 is in its second intermediate setting (FIG. 4) when the spark timing lever 92 is in its third position (FIG. 4).

Figure 3:
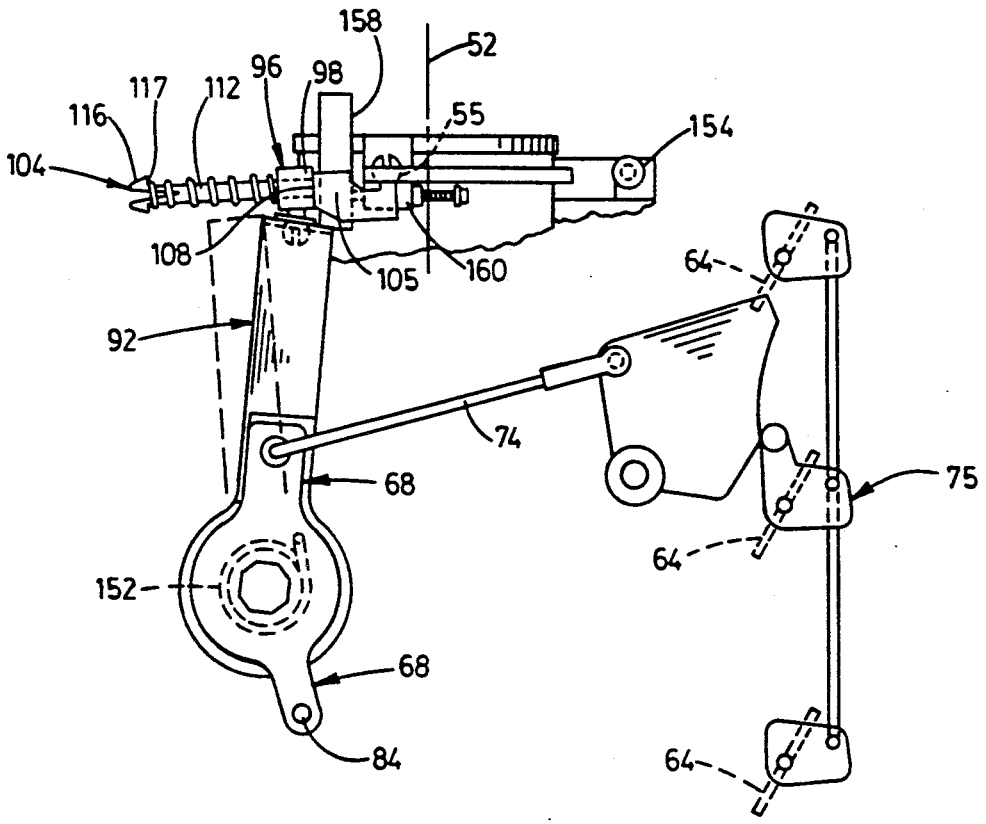
Figure 4:
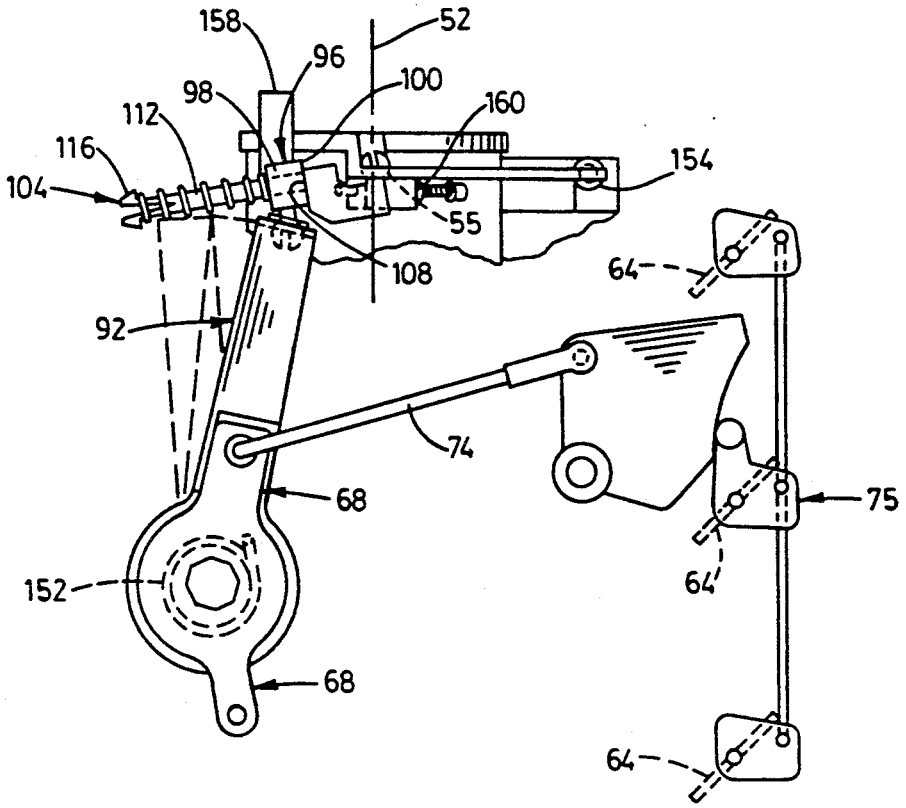

The spark timing means further includes return means for retarding spark from the maximum spark advance to the minimum spark advance in response to movement of the spark timing lever 92 from the third position (FIGS. 4 and 5) to the second position (FIG. 3). While various other means could be employed, in the preferred embodiment, the return means includes means acting between the spark timing link 104 and the spark timing lever 92 for biasing the surface 100 in the direction toward the stop 108 (to the right in the various FIGS.) and for maintaining the stop 108 in engagement with the surface 100 until the spark timing link 104 moves to the minimum advance position (FIGS. 2 and 3) from the maximum advance position (FIGS. 4 and 5).

While various other means could be employed, in the preferred embodiment, the means acting between the spark timing link 104 and the spark timing lever 92 includes a spring 156 surrounding the rod portion 112 of the spark timing link 104 and acting between the surface 118 and the surface 101 of the tubular guide portion 96. In assembly, the head 116 is radially inwardly compressed and the spring 156 is slid over the head 116, after the tubular guide portion 96 is slid over the head 116, and is retained in surrounding relation to the rod portion 112, as is the tubular guide portion 96, by the head 116 after the head 116 is released from its compressed state. In order for the spring 156 to hold the stop 108 against the surface 100 while the link 104 moves from the maximum spark advance position to the minimum spark advance position, the force of the spring 156 must be greater than the resistance to movement of the timer base 51.

Figure 7:
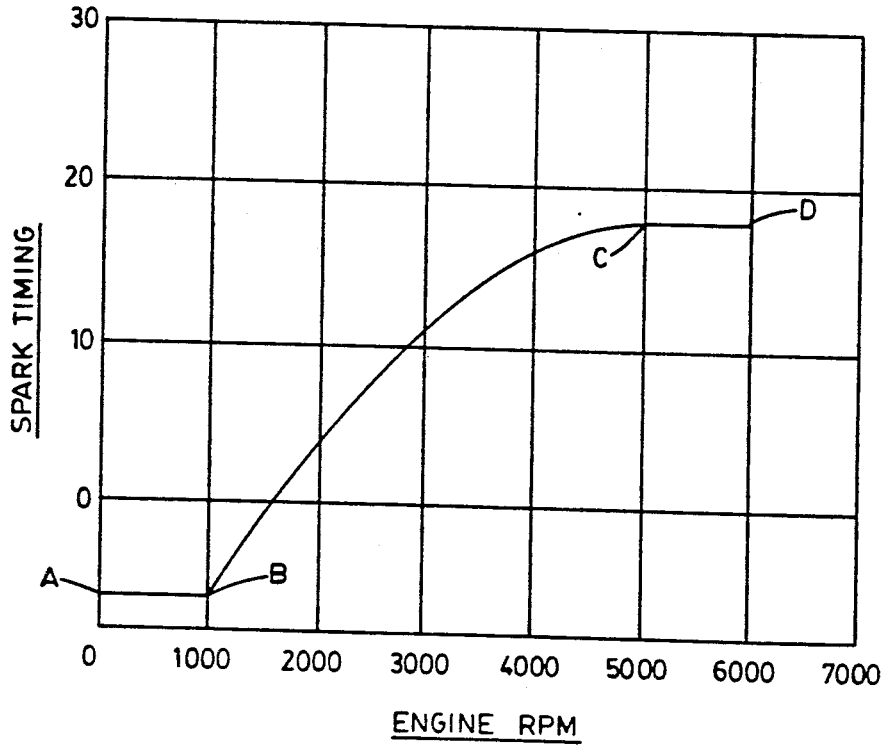
FIG. 7 is a plot of the relation between spark timing and engine rpm effected by the mechanism shown in FIGS. 1–6.

The operation of the internal combustion engine 28, and, more particularly, of the spark timing means and fuel supply mechanism 56, is illustrated in FIGS. 2 through 5. In addition, FIG. 7 shows a plot of spark timing versus engine rpm resulting from the disclosed construction of the internal combustion engine 28.

In FIG. 2, the control lever 68 positions the throttle link 74 so as to locate the throttles 64 in the idle speed setting. The raised stop 94 and the helical spring 152 locate the spark timing lever 92 in the first position. The spring 156 is compressed between the surface 118 and the surface 101 of the tubular guide portion 96 and biases the spark timing link 104 to the left and to its minimum spark advance position, thereby biasing the timer base 51 clockwise to the minimum spark advance setting whereat further clockwise movement of the timer base 51 is prevented by a stop 158, and by an adjustable screw 160 that engages the stop 158 at the minimum spark advance setting. The adjustable screw 160 is attached to the bottom of the timer base 51, and is movable with the time base 51. The stop 158 and the screw 160 are included in the spark timing mechanism. The positioning shown in FIG. 2 of the various components of the internal combustion engine 28 corresponds to the point "A" in the plot shown in FIG. 7.

Clockwise rotation of the control lever 68, in response to actuation of the single lever control 76, to the location shown in FIG. 3 results in the throttles 64 being moved to the first intermediate setting. The raised stop 94 and the helical spring 152 displace the spark timing lever 92 to the second position whereat the surface 100 of the tubular guide portion 96 engages the stop 108 of the spark timing link 104. The spring 156 remains compressed between the surface 118 and the tubular guide portion 96 and biases the spark timing link 104 to the left so that the timer base 51 remains in the minimum spark advance setting and so that the spark timing link 104 remains in the minimum advance position 124. The positioning shown in FIG. 3 of the various components of the internal combustion engine 28 corresponds to the point "B" in the plot shown in FIG. 7.

Further clockwise rotation of the control lever 68, in response to actuation of the single lever control 76, to the location shown in FIG. 4 results in the throttles 64 being moved to the second intermediate setting. The raised stop 94 and the helical spring 152 displace the spark timing lever 92 to the third position resulting in the surface 100 of the tubular guide portion 96 displacing the spark timing link 104 to the right to the maximum advance position, thereby displacing the timer base 51 to maximum spark advance setting. The spring 156 remains compressed between the surface 118 and the tubular guide portion 96 and biases the spark timing link 104 to the left so that the stop 108 on the spark timing link 104 remains in engagement with the surface 100 of the tubular guide portion 96 while the spark timing lever 92 moves between the second position (FIG. 3) and the third position (FIG. 4). The positioning shown in FIG. 4 of the various components of the internal combustion engine 28 corresponds to the point "C" in the plot shown in FIG. 7.

Further clockwise rotation of the control lever 68, in response to actuation of the single lever control 76, to the location shown in FIG. 5 causes the control lever 68 to rotate independently of the spark timing lever 92, as previously described, and results in the throttles 64 being moved to the full speed setting. The positioning shown in FIG. 5 of the various components of the internal combustion engine 28 corresponds to the point "D" in the plot shown in FIG. 7.

Counter-clockwise rotation of the control lever 68 from the location shown in FIG. 5 to the location shown in FIG. 2 results in the various other components of the internal combustion engine 28 moving in reverse sequence from the sequence described above. As mentioned above, the force of the spring 156 is sufficient to overcome resistance to movement of the timer base 51 and is sufficient to keep the surface 100 of the tubular guide portion 96 in engagement with the stop 108 of the spark timing link 104 during movement of the spark timing lever 92 from the third position (FIGS. 4 and 5) to the second position (FIG. 3).

Various of the features of the invention are set forth in the following claims.

We claim:

1. An engine comprising an engine block, a control lever supported by said engine block for pivotal movement about an axis and adapted to be connected to an operator controlled actuating member, a fuel supply mechanism operable between idle and full speed settings, means for displacing said fuel supply mechanism between said idle speed setting and said full speed setting in response to pivotal movement of said control lever, and spark timing means for advancing and retarding spark timing between a minimum spark advance and a maximum spark advance, and for beginning to advance the spark timing from said minimum spark advance only after displacement of said fuel supply mechanism from said idle speed setting to a first intermediate setting between said idle speed setting and said full speed setting, said spark timing means including a spark timing lever pivotally supported by said engine block for pivotal movement about said axis.

2. An engine in accordance with claim 1 wherein said spark timing means includes a spark timing mechanism operable between minimum spark advance and maximum spark advance settings, and means for displacing said spark timing mechanism between said minimum spark advance and said maximum spark advance in response to pivotal movement of said spark timing lever.

3. An engine in accordance with claim 2 and further comprising means providing for common pivotal movement of said spark timing lever and said control lever while said fuel supply mechanism is displaced from said idle speed setting to a second intermediate setting between said first intermediate setting and said full speed setting, and providing for pivotal movement of said control lever independent of said spark timing lever while said fuel supply mechanism is displaced from said second intermediate setting to said full speed setting.

4. An engine in accordance with claim 3 wherein displacement of said fuel supply mechanism to said second intermediate setting corresponds to displacement of said spark timing mechanism to maximum spark advance.

5. An engine in accordance with claim 2 wherein said means for displacing said spark timing mechanism includes a spark timing link that is connected to said spark timing mechanism and that is movable between a minimum advance position and a maximum advance position spaced in one direction from said minimum advance position, wherein said spark timing link comprises a stop, wherein said spark timing lever includes a surface, and wherein said spark timing lever is movable between a first position wherein said surface is spaced from said stop when said link is in said minimum advance position, a second position wherein said surface engages said stop when said link is in said minimum advance position so as to provide common movement of said link and said spark timing lever in response to further movement of said spark timing lever in said one direction, and a third position wherein said link is in said maximum advance position when said surface engages said stop.

6. An engine in accordance with claim 5 wherein said spark timing link includes an elongated rod portion extending from said stop, and wherein said spark timing lever includes a generally tubular guide slidably surrounding a portion of said elongated rod portion for movement between said stop, and a location on said rod corresponding to said spark timing lever being in said first position, said generally tubular guide defining said surface.

7. An engine in accordance with claim 6 wherein said tubular guide moves from said location on said rod to said stop when said fuel supply mechanism is displaced from said idle speed setting to said first intermediate setting.

8. An engine in accordance with claim 5 wherein said spark timing link moves with predominantly translational motion between said minimum advance position and said maximum advance position.

9. An engine in accordance with claim 5 wherein said spark timing means further includes return means for retarding spark from said maximum spark advance to said minimum spark advance in response to movement of said spark timing lever from said third position to said second position.

10. An engine in accordance with claim 9 wherein said return means includes means acting between said spark timing link and said spark timing lever for biasing said surface in a direction toward said stop and for maintaining said stop in engagement with said surface until said spark timing link moves to the minimum advance position from the maximum advance position.

11. An engine comprising an engine block, and spark timing means for advancing and retarding spark timing between a minimum spark advance and a maximum spark advance, said spark timing means including a spark timing link comprising a stop and being movable between a minimum advance position and a maximum advance position spaced in one direction from said minimum advance position, said spark timing means also including a spark timing lever including a surface and being movable between a first position wherein said surface is spaced from said stop when said link is in said minimum advance position, a second position wherein said surface engages said stop when said link is in said minimum advance position so as to provide common movement of said link and said spark timing lever in said one direction, and a third position wherein said link is in said maximum advance position when said surface engages said stop.

12. An engine in accordance with claim 11 wherein said spark timing means includes a spark timing mechanism, connected to said link, for advancing and retarding the spark between said minimum spark advance and said maximum spark advance.

13. An engine in accordance with claim 11 wherein said spark timing lever is supported by said engine block for pivotal movement about an axis.

14. An engine in accordance with claim 13 and further comprising a fuel supply mechanism operable between an idle speed setting and a full speed setting, a control lever supported by said engine block for pivotal movement about said axis about which said spark timing lever pivots, said control lever being adapted to be connected to an operator controlled actuator and to pivot in response to actuation of the operator controlled actuator, said engine further comprising means for displacing said fuel supply mechanism between said idle speed setting and said full speed setting in response to pivotal movement of said control lever.

15. An engine in accordance with claim 14 and further comprising means providing for common pivotal movement of said spark timing lever and said control lever while said fuel supply mechanism is displaced from said idle speed setting to an intermediate setting between said idle speed setting and said full speed setting, and providing for pivotal movement of said control lever independent of said spark timing lever while said fuel supply mechanism is displaced from said intermediate setting to said full speed setting, and such that said idle speed setting of said fuel supply mechanism corresponds to said first position of said spark timing lever, and such that said intermediate setting of said fuel supply mechanism corresponds to said third position of said spark timing lever.

16. An engine in accordance with claim 11 wherein said spark timing means further includes return means for causing said spark timing link to return to said minimum advance position from said maximum advance position in response to movement of said spark timing lever from said third position to said second position.

17. An engine in accordance with claim 16 wherein said return means includes means acting between said spark timing link and said spark timing lever for biasing said surface in a direction toward said stop and for maintaining said stop in engagement with said surface until said spark timing link moves to the minimum advance position from the maximum advance position.

18. A marine propulsion device comprising a propulsion unit including a rotatably supported propeller shaft, and an engine drivingly connected to said propeller shaft, said engine comprising an engine block, a control lever supported by said engine block for pivotal movement about an axis and adapted to be connected to an operator controlled actuating member, a fuel supply mechanism operable between idle and full speed settings, means for displacing said fuel supply mechanism between said idle speed setting and said full speed setting in response to pivotal movement of said control lever, and spark timing means for advancing and retarding spark timing between a minimum spark advance and a maximum spark advance, for beginning to advance the spark timing from said minimum spark advance only after displacement of said fuel supply mechanism from said idle speed setting to a first intermediate setting between said idle speed setting and said full speed setting, for advancing spark timing from minimum spark advance to maximum spark advance in response to displacement of said fuel supply mechanism from said first intermediate setting to a second intermediate setting between said first intermediate setting and said full speed setting, and for maintaining maximum spark advance in response to displacement of said fuel supply mechanism from said second intermediate setting to said full speed setting, said spark timing means including a spark timing mechanism operable between minimum spark advance and maximum spark advance settings, a spark timing link that comprises a stop and that moves with predominantly translational motion between a minimum advance position and a maximum advance position spaced in one direction from said minimum advance position, means for displacing said spark timing mechanism between said minimum spark advance and said maximum spark advance in response to movement of said spark timing link from said minimum advance position to said maximum advance position, a spark timing lever including a surface and being pivotally supported by said engine block for pivotal movement about said axis and between a first position wherein said surface of said spark timing lever is spaced from said stop when said link is in said minimum advance position, a second position wherein said surface engages said stop when said link is in said minimum advance position so as to provide common movement of said link and said spark timing lever in response to further movement of said spark timing lever in said one direction, and a third position wherein said link is in said maximum advance position when said surface engages said stop, and means providing for common pivotal movement of said spark timing lever and said control lever while said fuel supply mechanism is displaced from said idle speed setting to said second intermediate setting, and providing for pivotal movement of said control lever independent of said spark timing lever while said fuel supply mechanism is displaced from said second intermediate setting to said full speed setting.

19. A marine propulsion device in accordance with claim 18 wherein said spark timing means further includes return means for retarding spark from said maximum spark advance to said minimum spark advance in response to movement of said spark timing lever from said third position to said second position.

20. A marine propulsion device in accordance with claim 19 wherein said return means includes means acting between said spark timing link and said spark timing lever for biasing said surface in a direction toward said stop and for maintaining said stop in engagement with said surface until said spark timing link moves to the minimum advance position from the maximum advance position.

* * * * *